US007244898B2

(12) United States Patent
Kim

(10) Patent No.: US 7,244,898 B2
(45) Date of Patent: Jul. 17, 2007

(54) BUTTON ASSEMBLY FOR HOME APPLIANCE

(75) Inventor: Soo Bong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/929,375

(22) Filed: Aug. 31, 2004

(65) Prior Publication Data

US 2005/0194241 A1 Sep. 8, 2005

(30) Foreign Application Priority Data

Mar. 5, 2004 (KR) ..... 10-2004-0015091

(51) Int. Cl.
*H01H 9/00* (2006.01)

(52) U.S. Cl. ..... 200/314; 200/341; 200/521

(58) Field of Classification Search ..... 200/310–314, 200/315, 521, 513, 341
See application file for complete search history.

(56) References Cited

U.S. PATENT DOCUMENTS 3,968,336 A * 7/1976 Johnson ..... 200/5 A
5,252,798 A * 10/1993 Kamada ..... 200/314
5,285,037 A * 2/1994 Baranski et al. ..... 200/314
5,404,133 A * 4/1995 Moriike et al. ..... 340/815.56
5,712,459 A * 1/1998 Ziegler ..... 200/5 R
5,718,326 A * 2/1998 Larose et al. ..... 200/314
5,861,589 A * 1/1999 Sato et al. ..... 200/5 R
5,878,870 A * 3/1999 Ohtaki ..... 200/314
6,239,392 B1 * 5/2001 Serizawa et al. ..... 200/5 R
6,255,610 B1 * 7/2001 Botz et al. ..... 200/315
6,580,043 B1 * 6/2003 Spratte ..... 200/517

* cited by examiner

*Primary Examiner*—Kyung Lee
(74) *Attorney, Agent, or Firm*—Ked & Associates, LLP

(57) ABSTRACT

A button assembly for a home appliance is provided which allows for effective illumination of buttons. The button assembly includes a button body having buttons thereon which may pressed by a user to operate the appliance. The button body has a predetermined space inside, an elastic member which elastically supports the button body, a luminous body provided within the button body to emit light, and an extension extending from the button body which activates a corresponding switch, the extension being configured not to interfere with the luminous body.

21 Claims, 3 Drawing Sheets

BUTTON ASSEMBLY FOR HOME APPLIANCE

This application claims the benefit of Korean Application No. P2004-015091, filed on Mar. 5, 2004, which is hereby incorporated by reference.

BACKGROUND OF THE INVENTION

1. Field of the Invention

The present invention relates to a control panel of a home appliance, and more particularly, to a button assembly loaded in the control panel.

2. Discussion of the Related Art

Generally, a control panel assembly is provided to a home appliance to instruct an operation of the home appliance and to display an operational state thereof. The control panel assembly consists of a panel unit exposed to a user and a board held in the panel unit. Switches electrically connected to a control device, display device, and the like are mounted on the board, and various mechanical switches turning on/off the electrical switches on the board are provided to the panel unit. The mechanical switches include dials, sliders, push buttons, and the like. Specifically, a specific push button in installed in the panel unit to be pressed to turn on/off a specific function whenever pressed.

A general push button consists of a button body provided to the panel unit to be movable upward and downward, an elastic member installed between the button body and the panel unit to elastically support the button body, and a bar member provided to the button body to turn on/off a switch on the board by a user's force working on the button body. The bar member is provided to a central part of the button body. When the button body is pressed, the bar member is moved downward together with the button body to push the corresponding switch.

It is a recent tendency that an illumination function is added to the button to be easily found in the dark. However, the bar member hinders a luminous body from being installed at the above-explained general button. Even if the luminous body is installed to the button, the interference with the bar member or other parts of the button makes it difficult to illuminate the button body effectively.

SUMMARY OF THE INVENTION

Accordingly, the present invention is directed to a button assembly of a home appliance that substantially obviates one or more of the problems due to limitations and disadvantages of the related art.

An object of the present invention, which has been devised to solve the foregoing problem, lies in providing a button assembly of a home appliance, by which illumination is effectively achieved.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a button assembly of a home appliance including a button body configured to be pressed by a user, the button body having a predetermined space inside, an elastic member elastically supporting the button body to have the pressed button body return, a luminous body provided within the predetermined space of the button body to emit light, and an extension extending from the button body to press to actuate a switch, the extension configured not to interfere with the luminous body.

The button body is configured to transmit the light of the luminous body. Preferably, the button body includes a window enabling to transmit the light of the luminous body. And, the window is provided to a central part of the button body. Specifically, the button body includes an outer shell having a perforated hole of a predetermined size and an inner shell provided within the outer shell. And, the inner shell includes a transparent material closing the perforated hole. Preferably, the inner shell includes a protrusion inserted in the perforated hole. The elastic member includes a body supporting the button body and a leg elastically connecting the elastic member and the body.

The extension is configured not to block or cover the luminous body. And, the extension is configured not to be contacted with the luminous body. Preferably, the extension is spaced with a predetermined distance apart from the luminous body and is formed eccentric to the button body. More preferably, the extension is provided to an edge of a lower end of the button body. The luminous body is arranged on a central axis of the button body and may include a light emitting diode. Preferably, the luminous body continuously emits light or emits light only when the switch is on. By the above-explained present invention, the luminous body is installed within the button body without interference, whereby the button body can be effectively illuminated.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

Figure 1:
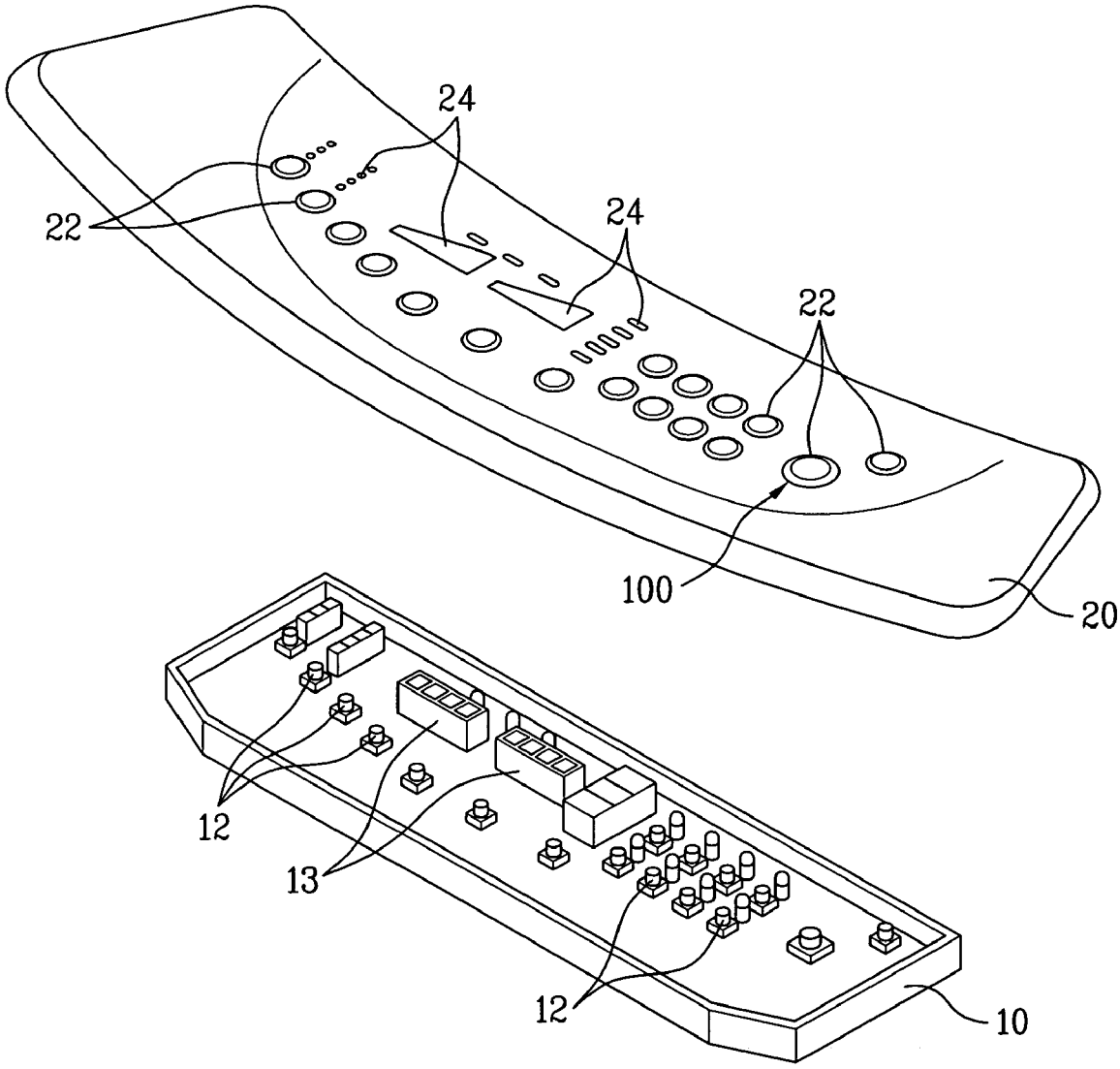
FIG. 1 is a disassembly diagram a control panel assembly of a home appliance including a button assembly according to the present invention.

FIG. 1 is a disassembly diagram a control panel assembly of a home appliance including a button assembly according to the present invention. Referring to FIG. 1, a control panel assembly of a home appliance mainly includes a board 10 and control panel 20 which are functionally connected to each other.

First of all, the board 10 forms a bottom of the control panel assembly to support various elements built in the assembly. Switches 12 as the elements for operating the home appliance and display devices 13 as the elements for displaying an operational state of the home appliance are mounted on the board 10. The switch 12 outputs a signal necessary for operating the home appliance and the display device emits light or displays predetermined information. Specifically, in case of applying the control panel assembly to a washing machine, waterproofing is more important than anything else to prevent malfunction. Hence, a waterproof layer is preferably formed on the board 10 to prevent the switches 12 and display devices 13 from being contacted with water. Such a waterproof layer can be formed of various kids of material and is generally formed of urethane.

The control panel 20 covers the board 10 and is exposed to a user for user's operation. The control panel 20 is configured to enable user's accessibility to the switches 12 and display devices 13. Namely, the control panel 20 is configured to enable a user to operate the switches 12 or to acquire information from the display devices 13. For this, at least one or more button holes 22 are formed on the control panel 20 to confront the corresponding switches 12 of the board 10, respectively. At least one or more display windows 24 are formed on the board 10 to confront the corresponding display devices 13 of the board 10, respectively. Characters, diagrams, and predetermined colors can be printed on the control panel 20, and more particularly, to the button holes 22 and the display windows 24 to assist a user in using the home appliance. Moreover, a button assembly 100 is installed in the button hole 22 and is configured to actuate the corresponding switch 12 by a mechanical movement. Namely, the switch 12 is configured to be alternately turned on and off whenever pressed. And, the button assembly 100 presses the switch 12 to repeatedly turn on and off whenever pressed by a user. The button assembly according to the present invention is explained in detail by referring to the attached drawings as follows.

Figure 2:
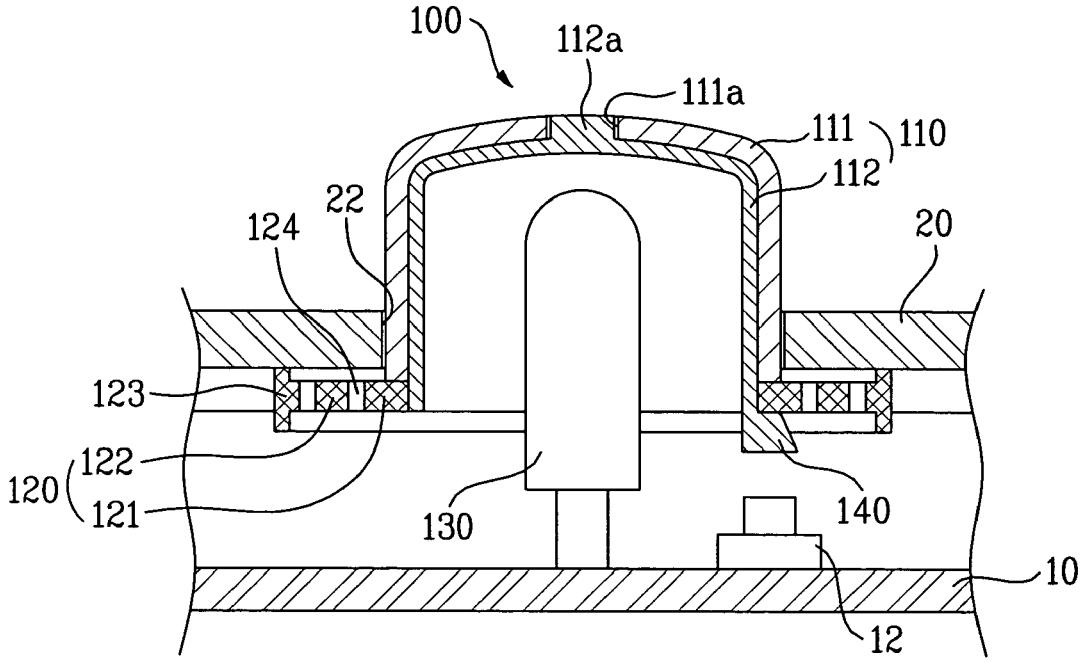
FIG. 2 is a cross-sectional diagram of a button assembly according to the present invention.
Figure 3:
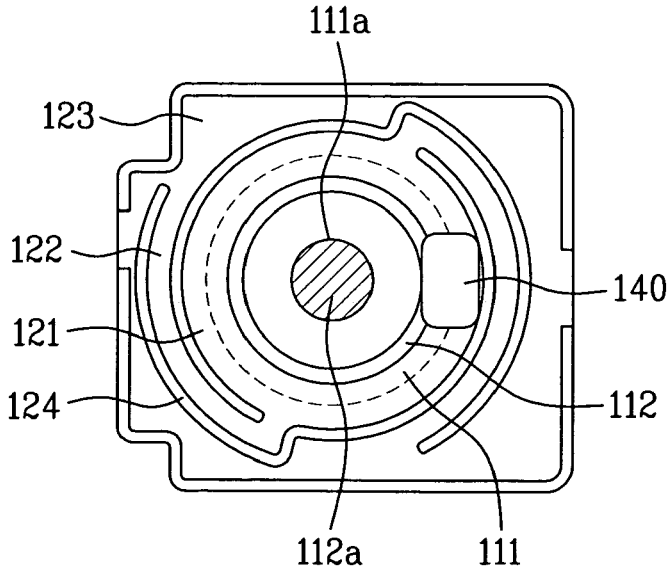
FIG. 3 is a diagram of a bottom side of a button assembly according to the present invention.
Figure 4:
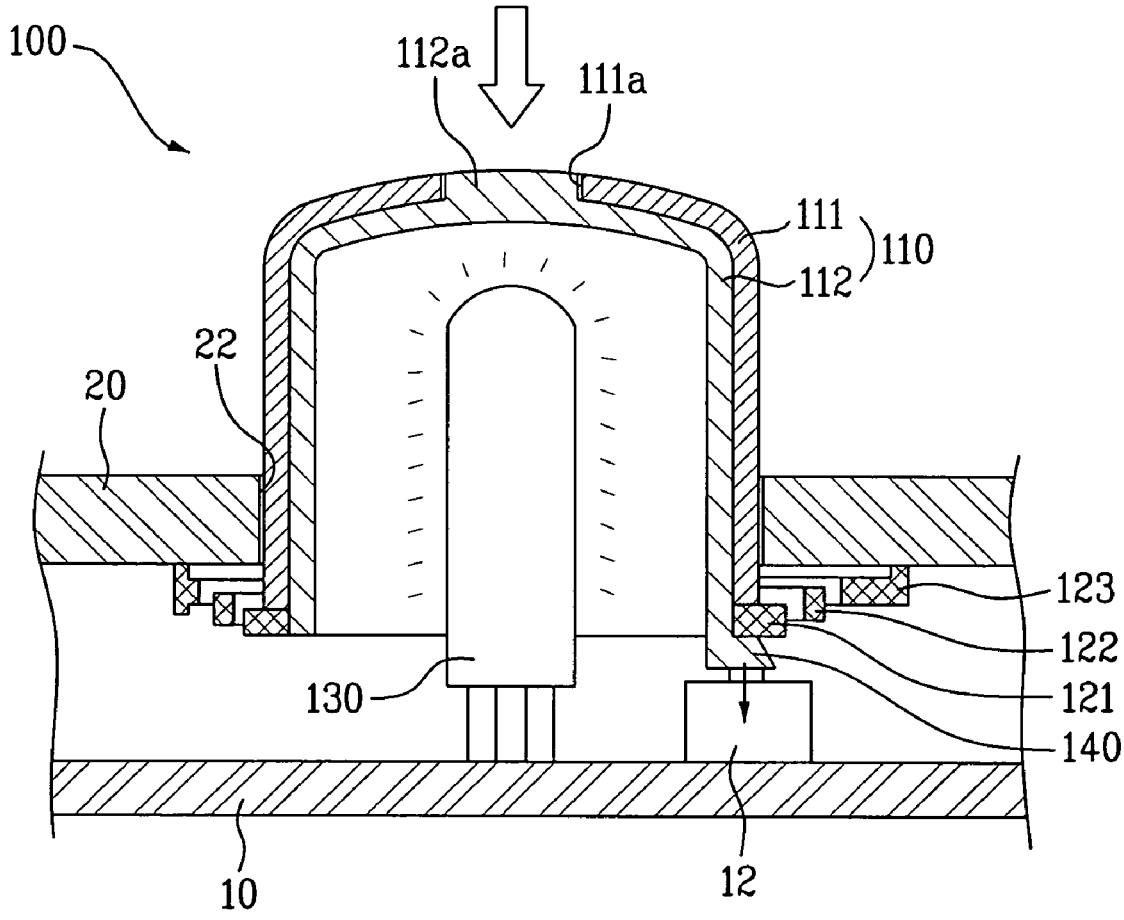
FIG. 4 is a cross-sectional diagram for showing an operation of a button assembly according to the present invention.

FIG. 2 is a cross-sectional diagram of a button assembly according to the present invention, FIG. 3 is a diagram of a bottom side of a button assembly according to the present invention, and FIG. 4 is a cross-sectional diagram for showing an operation of a button assembly according to the present invention.

A button assembly 100 according to the present invention, as shown in the drawings, includes a button body 110 provided between the board 10 and the control panel 20, an elastic member 120, a luminous body 130, and an extension 140. First of all, the button body 110 is movably installed within the button hole 22 of the control panel 20 in upper-to-lower direction and is configured to be pressed by a user. A space of a predetermined size is provided within the button body 110 to hold the luminous body 130 therein. Hence, the button body 110 is configured to transmit light of the luminous body 130 to be well identified by a user. Namely, the button body 110 may be formed of a transparent material overall to transmit the light of the luminous body 130. Yet, an inside of the control panel assembly is exposed to a user through the button body 110./ hence, the overall transparent button body 110 is not preferably. Preferably, the button body 110 9 is formed partially transparent to transmit the light of the luminous body in part. The button body 110 can be provided with a window transmitting the light of the luminous body in part. The button body 110 can be provided with a window transmitting the light of the luminous body 130 to enable a user to concentrate on the corresponding button. Such a window enables to transmit the light substantially. The window can be easily provided by forming a perforated hole in the button body 110. Yet, the perforated hole needs to be appropriately closed or sealed in order to prevent malfunction caused by external particles such as dust, moisture, and the like that enter the control panel assembly via the perforated hole. In order to provide an appropriately closed window, the button body 110 of the present invention can have a twofold configuration.

The button body 110, as shown in the drawing, includes an outer shell 111 and an inner shell 112 inside the outer shell 111. The outer shell 11 includes a perforated hole 111*a* transmitting light of the luminous body 130 and is formed of an opaque material overall. The inner shell 112 closes the perforated hole 111*a* and is formed of a transparent material. Moreover, the inner shell 112 includes a protrusion 112*a* fitted in the perforated hole 111*a* to provide the button body 110 with a smooth top surface. Thus, a window is provided to the button body 110 by the perforated hole 111*a* and the inner shell 112, whereby the light of the luminous body 130 can be seen by a user via the window. Preferably, the window is formed at a central part of the button body 110 to enable a user to identify the button body 110 well. Instead of the circular shape shown in the drawing, the window can have such a various shape as a ring shape along a rim of a top end of the button body 110 and other modified shapes.

The elastic member 120 is provided to the control panel 20 to support the button body 110 elastically. The elastic member 120, as clearly shown in FIG. 3, includes a body 121, a flange 123, and a leg 122 elastically connecting the body 121 and flange 123. The body 121 is configured to support the button body 110, and can be built in one body of a portion of the button body 110, i.e., the outer shell 111, to support the button body 110 more stably. The flange 123 is used in fixing the elastic member 120 to the control panel 20 together with a locking member. And, the leg 122 substantially forms a spiral cutting line 124 on the elastic member 120 to be relatively configured thereon. Hence, whenever pressed by an external force of the button body 110, the leg 122 is elastically transformed. Once the external force is released, the leg 122 is elastically restored to have the button body 110 return to its original position.

The luminous body 130, as mentioned in the foregoing description, is arranged in the space inside the button body 110 to emit light. The luminous body 130 is preferably located within a central axis of the button body 110 to enable to emit light evenly and may include a light emitting diode (LED). Moreover, the luminous body 130 can be configured to keep emitting light to facilitate a user to identify the corresponding button body 110. Alternatively, the luminous body 130 can be configured to be actuated when the corresponding switch 12 is turned on. Namely, whenever the switch 12 is repeatedly turned on and off by the pressed button body 110, the luminous body 130 is correspondingly turned on and off. In such a case, the light seen through the button body 110 enables a user to check whether the function given to the corresponding button is correctly performed. On the contrary, the luminous body 130 can be turned off when the corresponding switch is turned on 12, and vice versa, if necessary.

And, the extension 140 extends from the button body 110 to press the switch 12. The extension 140 is configured not to interfere with the luminous body 130. Specifically, the extension 140 is formed not to block the luminous body 110 so that the light of the luminous body 130 can be evenly applied to the button body 110. The extension 140, which is movable in upper-to-lower direction together with the button body 110, is formed not to come into contact with the luminous body during such a movement. Preferably, the extension 140 is spaced with a predetermined distance apart from the luminous body 130 not to touch or block the luminous body 130. Moreover, as the luminous body 130 is located within the central axis of the button body 110, the extension 140 is formed eccentric to the button body 110 in order for the luminous body 130 not to touch or block the luminous body 130. More preferably, the extension 140, as shown in the drawings, is provided to an edge of a lower end of the button body 110, thereby enabling to avoid interfering with the luminous body 130 at all. And, compared to a general button assembly, the extension 140 enables to allow a more sufficient inner space of the button body 110 for installing the luminous body therein. The switch 12 is placed under the edge of the lower end of the button body 110 to confront the extension 140, and a tip of the extension 140 expands to secure a stable contact with the switch 12. Hence, when a user presses the button body 110, the extension 140 is moved downward together with the button body 110 to push the corresponding switch 12.

An operation of the button assembly according to the present invention is explained as follows. Referring to FIG. 4, when a user presses the button body 110, the button body 110 is guided by the button hole 22 to move downward. Simultaneously, the extension 140 is moved toward the switch 12 together with the button body 110 to push the switch 12. Whenever a series of such a process is repeated, i.e., whenever the button body 110 is pressed, the switch 12 is turned on or off. In case that the luminous body 130 keeps emitting light, the user is facilitated to find to press the button even in the dark.

If the luminous body 130 is alternately turned on and off whenever the button body 110 is pressed by the user, the user enables to recognize the on/off state of the switch 12 with ease. Once the luminous body 130 is turned on by pressing the button body 110, the light passing through the pressed button body 110 helps the user find other buttons easily even in the dark space. Besides, if a predetermined symbol, character or the like is printed on the window of the button body 110, it can be more easily checked whether a specific function given to the corresponding button assembly is correctly carried out or not.

Accordingly, in the present invention, the extension for pushing the switch is provided to the edge of the lower end of the button body, whereby the luminous body can be installed within the button body. The luminous body enables the button body to efficiently transmit the light, whereby the user is facilitated to find to use the button.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A button assembly of a home appliance, comprising:

a button body configured to be pressed by a user, the button body having a predetermined space inside;

an elastic member elastically supporting the button body to have the pressed button body return, wherein the elastic member comprises:

a body supporting the button body, and a leg elastically connected to the body;

a luminous body provided within the predetermined space of the button body to emit light;

an extension extending from the button body to press to actuate a switch, the extension configured not to interfere with the luminous body;

a control panel; and a board, wherein the board is positioned opposing the control panel, wherein the elastic member supports the button body on the control panel, and wherein the switch is positioned on the board.

2. The button assembly of claim 1, wherein the button body is configured to transmit the light of the luminous body.

3. The button assembly of claim 1, wherein the button body comprises a window being able to transmit the light of the luminous body.

4. The button assembly of claim 3, wherein the window is provided to a central part of the button body.

5. The button assembly of claim 1, the button body comprising:

an outer shell having a perforated hole of a predetermined size; and an inner shell provided within the outer shell, the inner shell comprising a transparent material closing the perforated hole.

6. The button assembly of claim 5, wherein the inner shell comprises a protrusion inserted in the perforated hole.

7. The button assembly of claim 1, wherein the extension is configured not to block or cover the luminous body.

8. The button assembly of claim 1, wherein the extension is configured not to be in contact with the luminous body.

9. The button assembly of claim 1, wherein the extension is spaced with a predetermined distance apart from the luminous body.

10. The button assembly of claim 1, wherein the extension is formed eccentric to the button body.

11. The button assembly of claim 1, wherein the extension is provided to an edge of a lower end of the button body.

12. The button assembly of claim 1, wherein the extension gradually expands to be stably contacted with the switch.

13. The button assembly of claim 1, wherein the luminous body is arranged on a central axis of the button body.

14. The button assembly of claim 1, wherein the luminous body comprises a light emitting diode.

15. The button assembly of claim 1, wherein the luminous body continuously emits the light.

16. The button assembly of claim 1, wherein the luminous body emits the light when the switch is on.

17. A button assembly of a home appliance, comprising:

a button body configured to be pressed, and having an internal space;

a substantially flat elastic member elastically supporting the button body, and urging the pressed button body to return to an unpressed position, wherein the elastic member comprises:

a body contacting the button body;

a flange;

a leg, wherein the leg is positioned between the flange and the body, and wherein the leg is substantially formed by a spiral cutting line on the elastic member;

a luminous body provided within the internal space of the button body; and an extension formed on the button body configured to actuate a switch.

18. The bottom assembly of claim 17, wherein the elastic member is substantially flat because all of its components are substantially co-planar when the button body is in an unpressed position.

19. A button assembly of a home appliance, comprising:

a button body configured to be pressed by a user, the button body having a space inside;

an elastic member connected to the button body and elastically supporting the button body to have the pressed button body return to an unpressed position, wherein the elastic member includes a spiral cutting line;

a luminous body provided within the space of the button body to emit light; and an extension extending from the button body to press a switch, the extension configured not to interfere with the luminous body.

20. A button assembly of a home appliance comprising:

a button body configured to be pressed by a user, the button body having a predetermined space inside;

a separate elastic member elastically supporting the button body and configured to urge the button body to return to an un-pressed position, the elastic member comprising a body supporting the button body and a leg elastically connected to the body, wherein when the button is in an un-pressed position, the leg is substantially co-planar with the body;

a luminous body provided within the predetermined space of the button body to emit light; and an extension extending from the button body and configured to actuate a switch when the button body is pressed, the extension configured not to interfere with the luminous body.

21. The bottom assembly of claim 20, wherein the leg has a spiral shape.

* * * * *